United States Patent [19]

Cravens

[11] Patent Number: 5,064,114

[45] Date of Patent: Nov. 12, 1991

[54] MAILER

[76] Inventor: Harold Cravens, 6521 Winston Dr., Woodridge, Ill. 60517

[21] Appl. No.: 556,666

[22] Filed: Jul. 23, 1990

[51] Int. Cl.[5] ..... B65D 5/02

[52] U.S. Cl. ..... 229/40; 206/424

[58] Field of Search ..... 206/424; 229/40

[56] References Cited

U.S. PATENT DOCUMENTS

| | | | |
|---|---|---|---|
| Re. 30,163 | 12/1979 | Meyer et al. | 206/424 |
| 3,682,370 | 8/1972 | Rous | 206/424 |
| 3,722,668 | 3/1973 | Carpenter | 206/424 |
| 3,884,352 | 5/1975 | Pilz, III et al. | 206/424 |
| 3,896,990 | 7/1975 | Sieffert | 206/424 |
| 3,986,608 | 10/1976 | Rous | 206/424 |
| 3,989,141 | 11/1976 | Rous | 206/424 |

*Primary Examiner*—Joseph Man-Fu Moy

*Attorney, Agent, or Firm*—Hill, Van Santen, Steadman & Simpson

[57] ABSTRACT

There is disclosed herein a box-like container for use in mailing rectangular items such as a book. The container includes shaped outwardly extending and longitudinal side edge and corner formations that form protectors so that items carried within the container are protected from forces impacting on the side edges or corners of the container. This container may be opened so as to receive book-like items either for individual mailing or mass mailing. Moreover, various types of end formations are provided for closure and sealing of the container. A blank from which the foregoing container is fabricated is also disclosed.

10 Claims, 4 Drawing Sheets

MAILER

BACKGROUND OF THE INVENTION

This invention relates to containers, and more specifically to mailing devices.

Mailing devices are known in the industry and are generally containers, usually boxes, which are folded from cardboard blanks to form the container into which articles to be shipped are placed. These containers are sometimes known as mailers. Books are regularly shipped in rectangularly-shaped boxes which can be easily mailed. Mailers in addition to providing a container for the item are intended to protect the item. Present book mailers have a problem in that the corners and/or sides of the containers may be damaged during handling and shipping, and as a result, a book therein may also be damaged, usually at corners or along its sides.

It is therefore an object of this invention to provide a container with corner and/or side formations which are constructed to minimize damage to a book or the like contained therein.

Moreover, such containers are used for shipment by both individuals and mass mailings. Therefore, it is an object to provide containers which are suitable for both individual and mass mailings and which can be loaded manually or automatically.

These and other objects of this invention will become apparent from the following disclosure and appended claims.

SUMMARY OF THE INVENTION

There is disclosed herein a box-like container for use in mailing rectangular items such as a book, which includes shaped outwardly extending and elongated side edge and corner formations that form protectors so that items carried within the container are protected from forces impacting on the side edges or corners of the container. This container may be opened so as to receive book-like items, either for individual mailing or mass mailing. Moreover, various types of end formations are provided for the closure and sealing of the container. A blank from which the foregoing container is fabricated is disclosed.

DESCRIPTION OF THE PREFERRED EMBODIMENT

Figure 1:
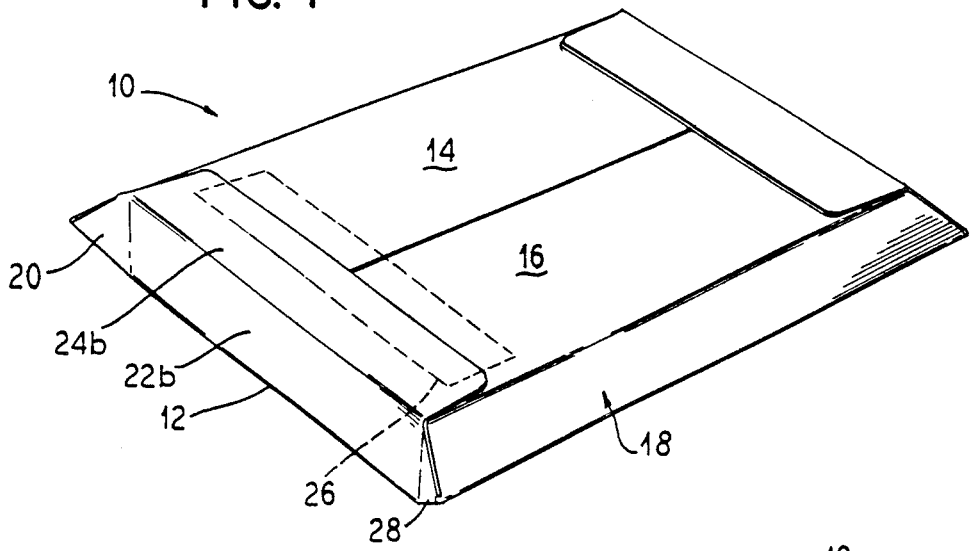
FIG. 1 is a perspective view of a container in accordance with this invention and having the elongated, projecting and protective side edges and corner formations and having an end flap closure.
Figure 5:
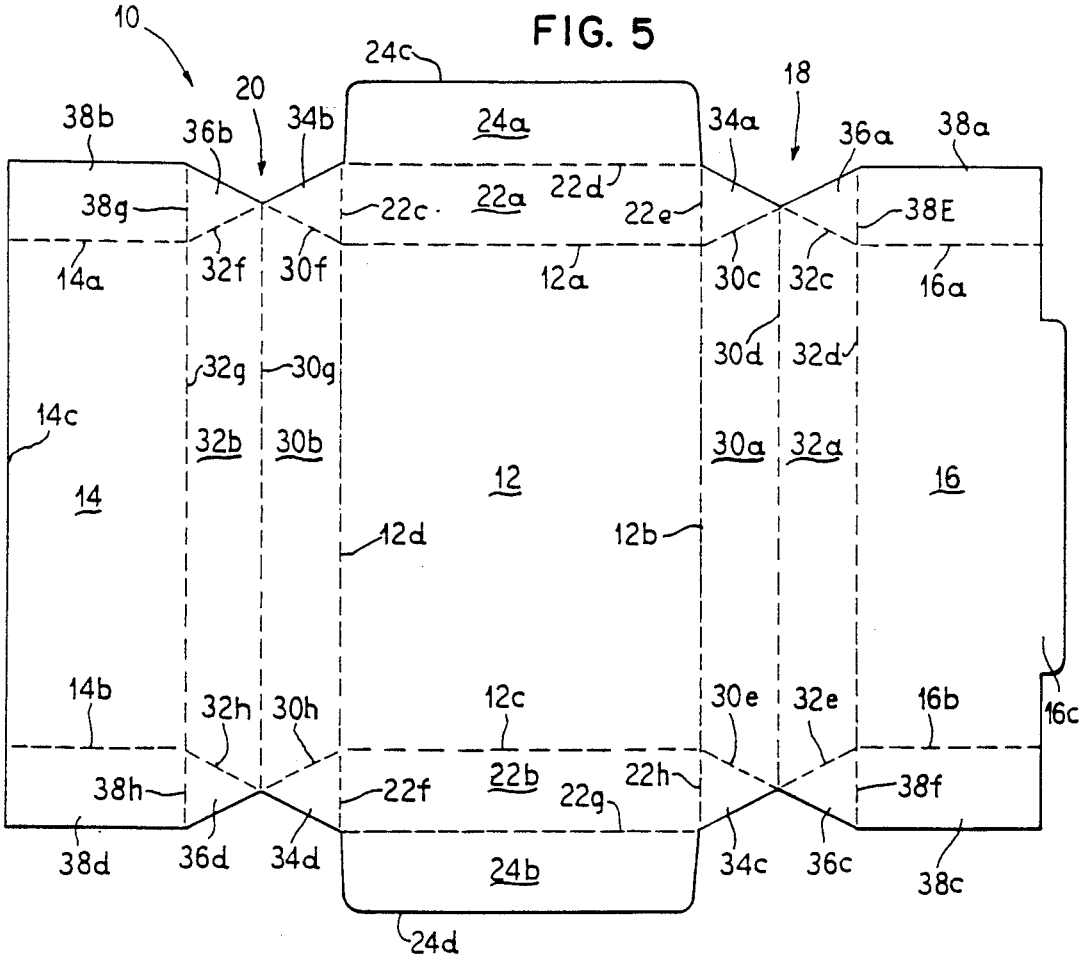
FIG. 5 is a development view of a blank from which the container such as shown in FIG. 1 is fabricated and showing various cut and score lines.

Referring to FIG. 1 in conjunction with FIG. 5, there is shown a mailer 10 generally which includes a bottom, primary or central panel 12, a pair of smaller top or secondary panels 14 and 16, and protective side formations or projections 18 and 20 along the sides of the container. The side projections, such as 18 and 20, are triangularly-shaped formations which extend outwardly from the container and also form end or corner projections. In the event the container is damaged during handling and shipping, it is believed that the side or end formations will engage a potentially damaging surface or object and protect articles in the container such as books or other articles susceptible to damaging deformation.

An end closure is provided at one end of the mailer in the form of an outer end wall **22*b* and an end flap 24*b*. An adhesive tape 26 is shown securing the end flap 24*b* to the top panels 14 and 16**.

Referring further to the blank for such a box as shown in FIG. 5, the bottom wall 12 is defined by score lines **12*a*, 12*b*, 12*c* and 12*d*. The end panel outer walls, such as 22*a* and 22*b*, are attached to the central panel via score lines 12*a* and 12*c* and are edged by the score lines, such as 12*a*, 22*c*, 22*d* & 22*e* and 12*c*, 22*f*, 22*g* & 22*h*. End flaps such as 24*a* and 24*b* are connected to the respective outer end wall formations via the score lines such as 22*d* and 22*g*. The outer sides of the end flaps 24*a* and 24*b* are formed by cut lines 24*c* and 24*d*. Each of the side formations, such as 18 and 20, are formed by two panels between the top and bottom panels such as 30*a* & 32*a* and 30*b* & 32*b*. The bottom side panels such as 30*a* and 30*b* are formed by score lines such as 12*b*, 30*c*, 30*d* & 30*e* and 12*d*, 30*f*, 30*g* & 30*h*. The top side panels 32*a* and 32*b* are formed by the score lines such as 30*d*, 32*c*, 32*d* & 32*e* and 30*g*, 32*f*, 32*g* & 32*h***.

It is to be noted that the top or secondary wall is formed by panels 14 and 16 which are in effect half panels and are bounded by the score lines **32*d* & 32*g*, 16*a* & 16*b* and 14*a* & 14*b*. The free edge of the panel 16 has a glue flap 16*c* which can be extended or voided. If voided, the edge 14*c*** can be placed in abutting adjacency and a strip of adhesive material adhered to the adjoining edges.

Figure 2:
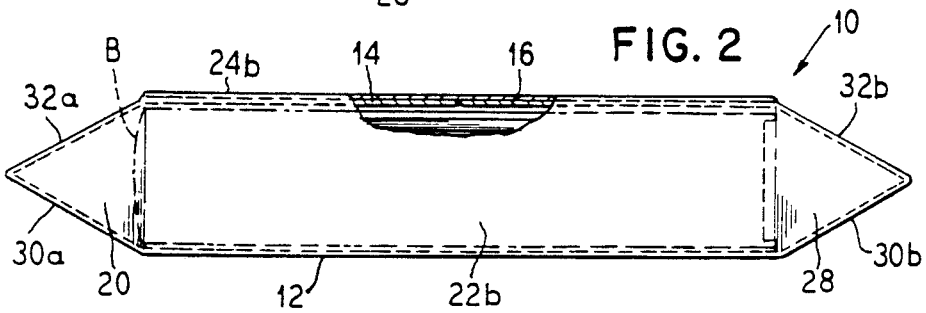
FIG. 2 is an end elevational view of the container of FIG. 1 with a book shown in phantom.
Figure 3:
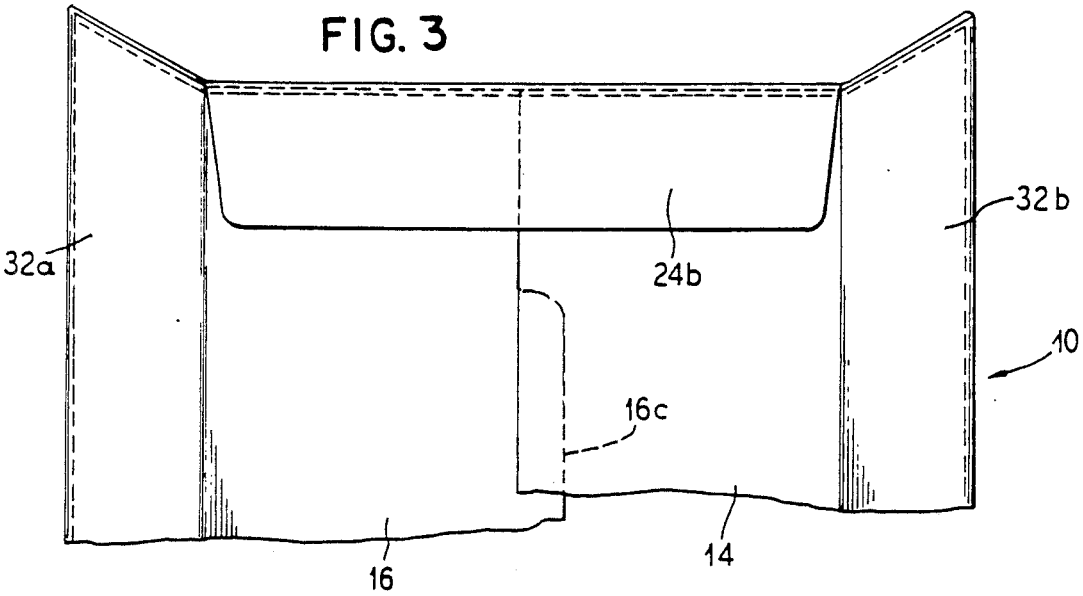
FIG. 3 is an enlarged fragmentary plan view showing one end of the container of FIG. 1.
Figure 4:
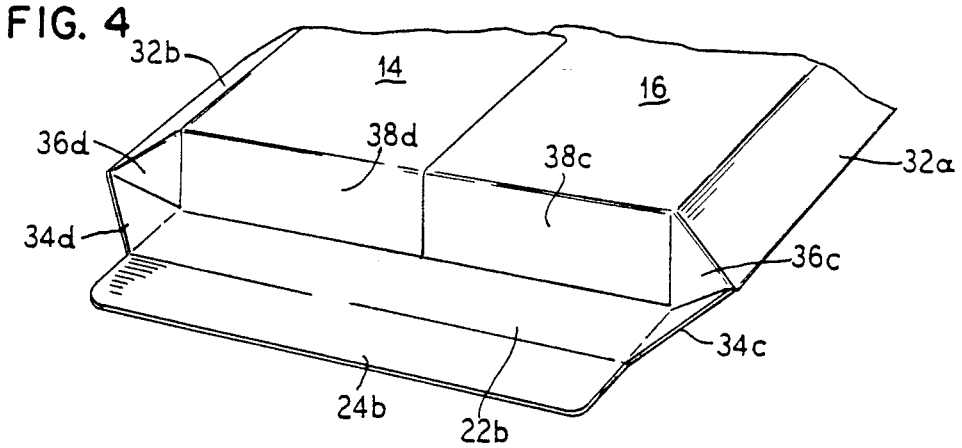
FIG. 4 is an end view of a container similar to that shown in FIG. 1 and showing an end closure system.

It is to be noted that the spacing dimension between the side wall score lines, such as **12*b* and 32*d*, is greater than the spacing dimension of the end panels 22*a* and 22*b* which corresponds to the thickness of the item to be contained. Thus, the end panels 22*a* and 22*b* approximate the size of a book B (shown in phantom in FIG. 2) to be mailed in the container 10, and when assembled the distance between the main panel 12 and the secondary panels 14 and 16 approximate the book. When assembled the side wall formations form an outwardly projecting cushion or triangularly shaped protective barrier which serves to cushion or protect the sides and edges of the article. The inner end walls 38***a*, 38*b*, 38*c* & 38*d* are formed adjacent the secondary panels. These walls are formed by score lines, such as 16*a* & 38*e*, 16*b* & 38*f*, 14*a* & 38*g*, and 14*b* & 38*h*.

The side walls and inner and outer end walls are connected via triangularly-shaped, gusset-like elements 34*a*, 34*b*, 34*c* & 34*d* and 36*a*, 36*b*, 36*c* & 36*d*. These elements are shown connected to the respective walls by the score lines indicated. It is noted that the score lines 30*d* and 30*g* dividing the two side wall panels are longer than the score lines 12*b* and 12*d* and thus form triangular gusset-like elements having an apex where the line 30*d* engages the elements 34*a* and 36*a* is positioned about centrally of the end walls on either end.

To form the container, the top walls 14 and 16 are folded upwardly over the bottom wall 12, and thus form the side walls into the side projections. The inner end wall 38*c* is folded downwardly to close the container, which leaves open the end wall 22*b* and end flap 24*b*. The end wall 22*a* is folded upwardly and the flap 24*a* is sealed to close the container. Using this type of formation, a structure such as shown in FIG. 1 is produced.

In terms of use and in individual situations, the end walls, such as 38*c* and 38*d*, are open, a book is inserted into the mailer, the walls 38*c* and 38*d* are closed, then the end wall 22*b* is folded upwardly thereover, and end flap 24*b* is folded onto panels 14 and 16 and adhered in position.

In terms of machine use, the walls 14 and 16 are folded over and joined either by taping or with the use of the glue flap 16*c*. The mailer in flat condition can then be opened by squeezing on the side formations 18 and 20 thereby to open the mouth of the mailer at both ends. A book or other article can be inserted in one end, for example, the end 22*b*, 24*b*, whereupon adhesive can be applied along flap 24*b* and the mailer closed and sealed shut. The opposite end 22*a*, 24*a* can be closed and sealed in a similar manner.

Figure 6:
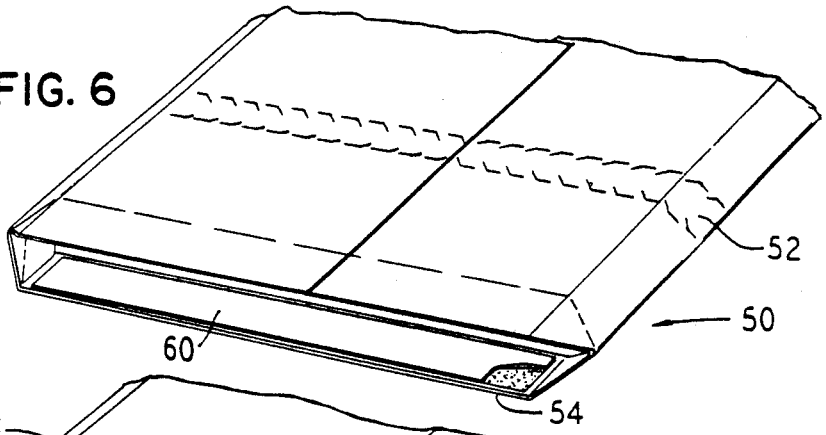
FIG. 6 is an open end view of a modification whereby the end of a container has a self-sealing end system and a zipper opening system.
Figure 7:
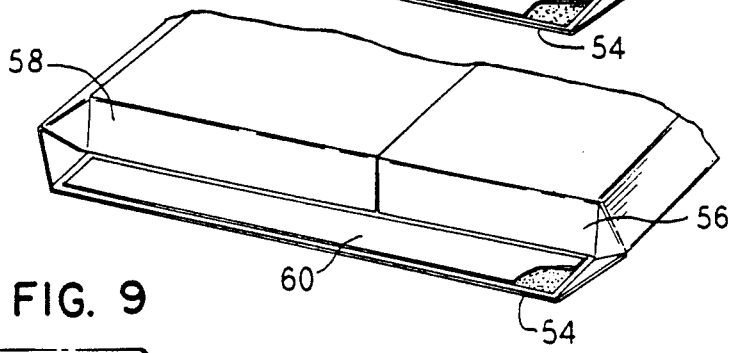
FIG. 7 is a view similar to FIG. 6 but showing the closure of the system.

A related construction is shown in FIGS. 6 and 7. In FIG. 6 the basic mailer design, generally referred to as 50, is used and a perforated zipper-type of construction is shown at 52 for opening the mailer 50 and extends transversely thereacross. The end panels have a similar construction but have an adhesive pad 60 along one end wall 54 and no end flap. In operation, the inner end walls 56 and 58 are closed, and the outer end wall 54 is folded upwardly so that the adhesive pad 60 will bond to the inner end walls thereby forming a sealed package.

Turning now to FIGS. 8–11, yet another embodiment of this system is shown. In this embodiment an interlocking tab system is provided securing the closure flap in position and preventing opening of the mailer without giving an indication of tampering.

Figure 11:
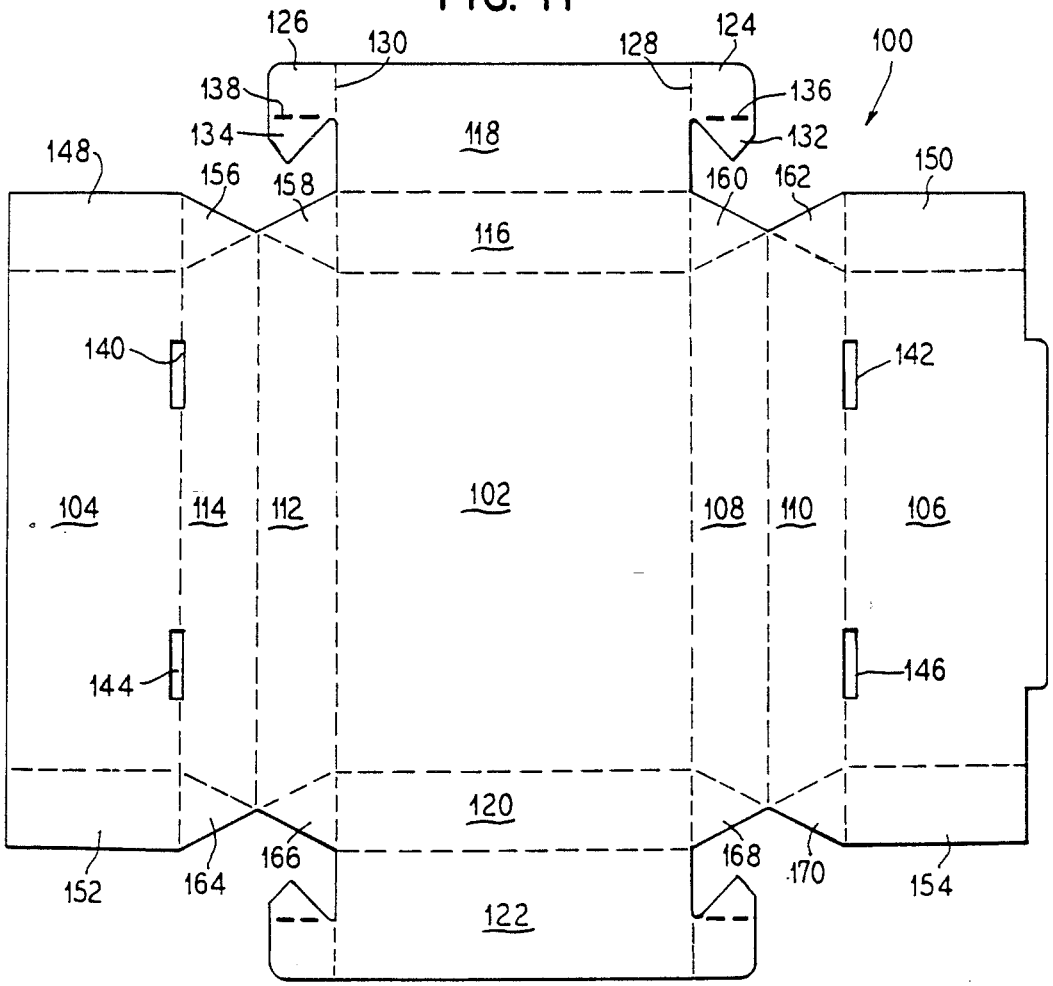
FIG. 11 is a development view of a blank which is cut and scored for use in the tab-type of system shown in FIGS. 3, 8, 9 and 10.

Referring to FIG. 11, the box blank 100 is shown. The blank 100 includes a bottom panel 102 and a pair of top half panels 104 and 106 trapezoidally shaped and projecting side walls 108 and 110, which connect the main panel 102 with the top panel 106. Panels 112 and 114 connect the main panel 102 to the other top panel 104. These panels are defined by the score lines as shown. End panels such as 116 and 120 and flaps such as 118 and 122 are provided. The panels, such as 116, form the outer end wall and the panel 118 forms the flap which is folded over onto the top. The panel 118 also includes end panel formations 124 and 126, which are foldable along score lines 128 and 130. The tabs 132 and 134 define a pointed and four-sided figure and are connected to the end tabs 124 and 126 by score lines 136 and 138. A similar end flap and end tab construction is provided at the other end of the box in connection with panel 122.

Slots 140, 142, 144 and 146, are provided in the top panels 104 and 106 along the score lines or adjacent with the side edges. These slots are arranged to cooperate with the end tabs 124 and 126. Interior end wall panel formation, such as 148, 150, 152 and 154, are provided. They cooperate with the triangularly-shaped side or gusset panels 156, 158, 160, 162, 164, 166, 168 and 170. The blank is shown assembled in FIG. 8. Here the box is formed and the end panel 122 is flat or horizontal. In order to close the system as shown at the other end of the box, the end tabs 126 are folded along score lines 130 and 124 along line 128. This raises the locking tab into a position transverse to the flap 118. When the box is formed the locking tabs fit into the slots 140 and 142. In other words, by folding tab 134 180° on line 138 and tab 132 180° on line 136, tab 132 and 134 can fit into slots 140 and 142, thereby locking the box in a closed position.

Figure 9:
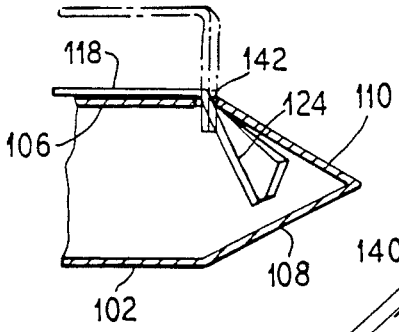
FIG. 9 is a sectional view taken along line IX—IX of FIG. 8 and showing interlocking tabs inserted into a container.
Figure 8:
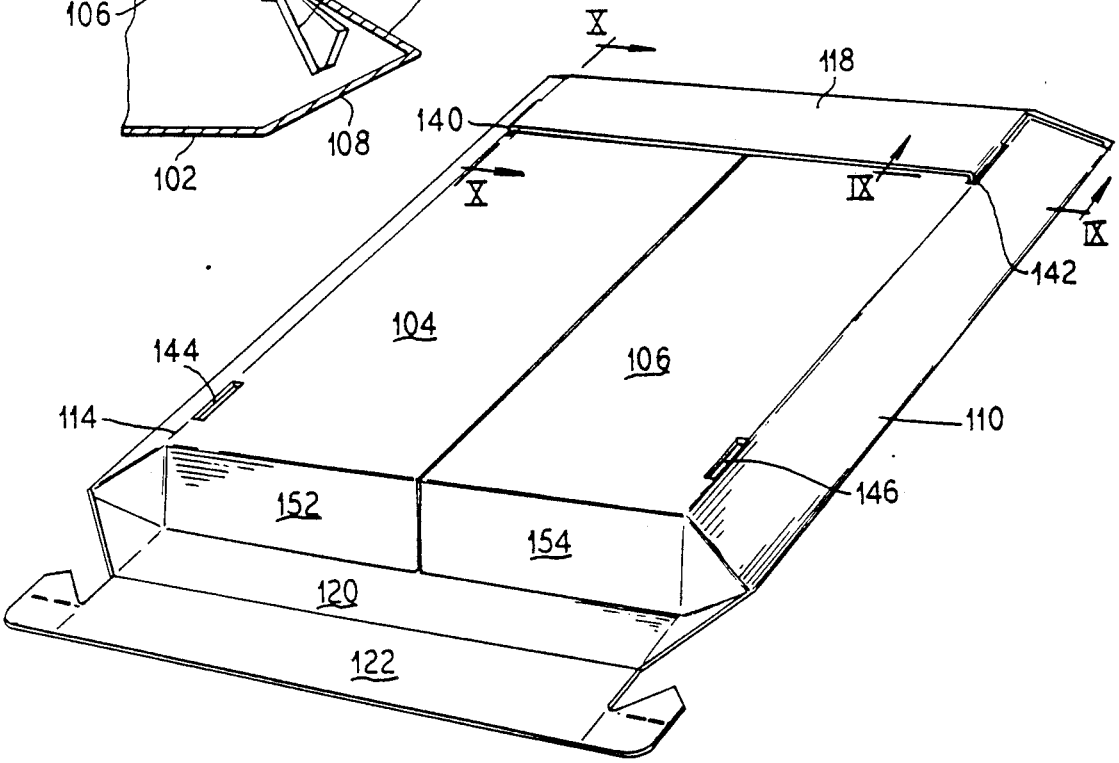
FIG. 8 is a perspective view showing a similar type of system to that of FIG. 1 but showing interlocking closure tabs.

As shown in FIG. 9, the tabs 126 and 124 and the locking tabs 132 and 134 are pressed into the slots 140 and 142 for locking the flap 118 down onto the body of the mailer.

Figure 10:
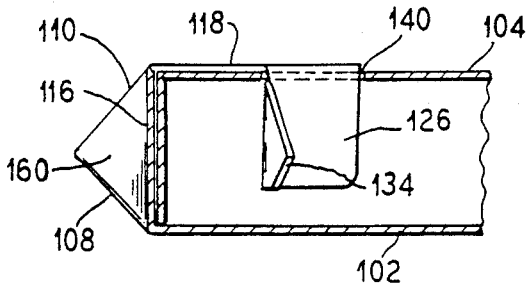
FIG. 10 is a sectional view taken along line X—X of FIG. 8 also showing interlocking of the interlocking tabs inserted into the container.

Referring now to FIG. 10, tab 126 and tab 134 are shown. The locking part 132 of the tab 124 folds to the outside panels 110 and 108 and after insertion, flips toward the panels 110 and 108. With the size of the angled tab being larger than the opening created by the panels 108 and 110, the tab 132 will hang up on panel 110 at about an 80° angle to the adjoining panel 124. Using a mailer of the type disclosed in FIGS. 8–11, the mailer can be used when inserting books, either manually or by machine.

Although the invention has been described with respect to preferred embodiments, it is not to be so limited as changes and modifications can be made which are within the full intended scope of the invention as defined by the appended claims.

I claim as my invention:

1. A mailing container comprising a unitary sheet-form member scored and cut to form a main body panel having an end panel at each end thereof and foldable to provide end walls for the container, an outwardly gussetted side panel connected to said main body panel at each side thereof, each said side panel having two components with a score line therebetween and together with one another having a dimension greater than that of said end panels, whereby said side panel will fold into a triangularly configured buffer projecting outwardly of said main body panel, a secondary panel connected to each said side panel and foldable inwardly to overlie said main body panel, and a flap extending from each said end panel for being folded back in a reverse direction to overlie said secondary panels thereby to lock the panels in an assembled position.

2. A mailing container as defined in claim 1 and further characterized by each said side panel having at opposite ends thereof triangular gusset-like elements foldable upon assembly to project longitudinally beyond the end of the container thereby to provide additional buffer protection for the contents of the container.

3. A mailing container as defined in claim 2 and further characterized by each said side flap having a laterally projecting locking tab, and said container having a corresponding plurality of slots formed between said secondary panel and its corresponding side panel and each said slot adapted to receive one of said locking tabs to lock the container in firm assembly.

4. A mailing container as defined in claim 3 wherein each said flap has a laterally projecting locking tab formed with a locking part extending longitudinally, said locking parts folding to the outside and flipping at an angle to the adjoining panel after insertion of said tab into a corresponding slot.

5. A mailing container as in claim 1, wherein there is further provided adhesive means on one of said end panels at the end of said main body panel and arranged to engage and bond to an adjoining secondary panel so as to seal said container.

6. A mailing container as in claim 1, wherein said side panels and said secondary panels define at least one row of zipper-like perforations generally parallel to the end panels for opening the mailing container.

7. A mailing container as in claim 1, wherein there is further provided adhesive means for securing said flap to an adjoining one of said secondary panels.

8. A mailing container as in claim 1, wherein said secondary panels and the adjacent side panels define tab-receiving slots and there is further provided tab formations hingedly associated with each of said end flaps which are constructed to be positioned to extend into one of said slots so as to secure said flap and outer end panel in position.

9. A mailing container as in claim 1, wherein each of said side panels include two elongated side members hingedly connected together and to said secondary panels to form a triangular shape and forming an additional protective buffer.

10. A container as in claim 9, wherein gusset members are provided in hinged association with said side panels and end panels for closing the mailing container.

* * * * *